US005730706A

United States Patent [19]

Garnies

[11] Patent Number: 5,730,706

[45] Date of Patent: Mar. 24, 1998

[54] SPINAL THERAPEUTIC DEVICE

[75] Inventor: Dieter Garnies, Bergisch Gladbach, Germany

[73] Assignee: Krahnen GmbH, Cologne, Germany

[21] Appl. No.: 739,301

[22] Filed: Oct. 29, 1996

Related U.S. Application Data

[63] Continuation of Ser. No. 406,884, filed as PCT/DE94/00839, Jul. 19,1994, abandoned.

[30] Foreign Application Priority Data

Jul. 21, 1993 [DE] Germany ..... 43 24 446.7

[51] Int. Cl.[6] ..... A61H 1/00

[52] U.S. Cl. ..... 601/23; 601/24; 601/26; 606/241; 602/32; 602/33

[58] Field of Search ..... 601/5, 15, 23, 601/24, 26, 27, 35, 64, 89, 90, 93, 97, 98, 100; 602/32–36; 606/241

[56] References Cited

U.S. PATENT DOCUMENTS

| | | | |
|---|---|---|---|
| 1,765,669 | 6/1930 | Henze et al. | 602/32 |
| 1,837,037 | 12/1931 | Gillberg | 602/33 |
| 2,475,003 | 7/1949 | Black | 601/26 |
| 2,591,212 | 4/1952 | Stauffer | 601/93 |
| 3,117,572 | 1/1964 | Wright | 602/32 |
| 3,640,272 | 2/1972 | Hussey | 601/99 |
| 3,835,844 | 9/1974 | Lang | 601/15 |
| 4,483,330 | 11/1984 | Jacobsen et al. | 602/32 |
| 4,628,188 | 12/1986 | Andreasson | 219/528 |
| 5,277,681 | 1/1994 | Holt | 482/907 |
| 5,383,919 | 1/1995 | Kelly et al. | 601/15 |

*Primary Examiner*—Jeanne M. Clark
*Attorney, Agent, or Firm*—Fildes & Outland, P.C.

[57] ABSTRACT

For the treatment of spinal damage in medical physiotherapy, the patient's spine is stressed via the pelvis by longitudinal forces on the legs in such a way that the setting of displaced spinal components is promoted and the muscles are strengthened. With this device the tensile forces are applied to the feet by spring components which are tensioned by means of cables from the movements of the pins of linear movement components driven by an electric motor. The frequency and amplitude of these tensile forces can be changed via a control unit and thus phase shifts between the forces acting on the legs can be adjusted. During the exercises the patient can adjust the exercise programme by actuating controls connected to the supporting grips. The success of the therapy can be improved by fitting heating elements in the backrest to provide heat treatment for the patient's muscles.

12 Claims, 2 Drawing Sheets

SPINAL THERAPEUTIC DEVICE

Figure 1:
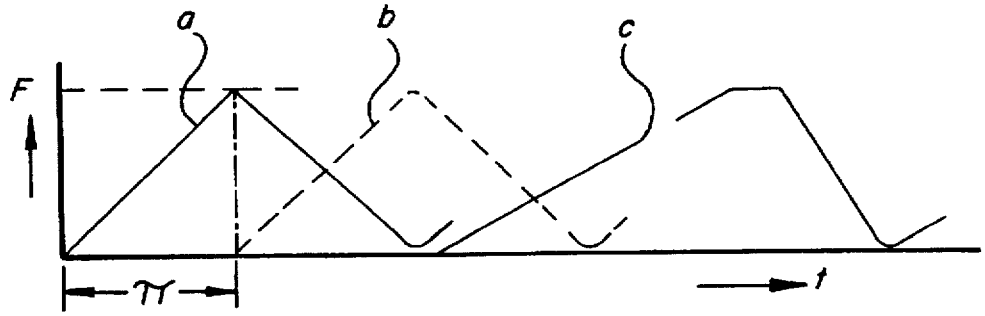

This application is a continuation of application Ser. No. 08/406,884, filed as PCT/DE94/00839, Jul. 19, 1994, now abandoned.

In order to treat damage to the human spine, e.g. to the intervertebral discs, and deformities, therapeutic devices are used in the field of physiotherapy which promote the setting of displaced spinal components and strengthen the muscles around them.

The devices are primarily designed in such a way that the patient lies on a bench and is positioned by way of pelvic and head braces. His legs are raised and the feet attached via cables to a device mounted on one wall of the room. In this way, cable forces produce a stretching effect on the spine. With the patient in this position, diverse exercises are performed under the instruction of a therapist which influence the position of the spine and promote regeneration. In this context, exercises in which tensile forces applied to the feet stress the legs, the pelvis and finally the spine, prove to be particularly effective. In this case, both legs are used simultaneously, or alternately as in bike-riding.

This treatment method usually requires a stationary treatment bench with auxiliary fixtures. A tension mechanism for positioning the legs is mounted on a wall away from the bench and the tensile forces are generated by the therapist who performs the exercises with the patient.

The invention described below is based on the task of designing a spinal therapeutic device which promotes the setting of displaced spinal components and strengthens the muscles around them, where the therapeutic movements are triggered by a motor-driven system and the exercises can be performed by the patient himself, without the help of another person.

According to the invention, the task is solved in that spring elements are stretched by controllable and/or adjustable mechanical drives—also hydraulic and pneumatic drives—which generate a back-and-forth motion and the resulting spring forces are transmitted as tensile forces via cables to the feet of the patient, where the forces act in the same direction on both legs simultaneously, or alternately with a phase shift, and the intermediate values of this phase shift can be set.

In order to be able to perform a wide range of therapeutic exercises, it is preferable to have the option of changing the amplitude and frequency of the tensile forces during the exercises in the therapy programme.

The following cases are essentially envisaged for changing the force-time profiles acting on the legs of the patient:

1. Increasing and decreasing forces act on both legs simultaneously,
2. Both legs are stressed alternately with both forces phase-shifted by $\pi$ (comparable to bike-riding),
3. The phase shift is infinitely variable from 0 (Case 1) to $\pi$ (Case 2),
4. The amplitude of the forces can be set simultaneously for both legs, or also independently for each leg,
5. The time interval for the increase and decrease of the forces and the holding time in special positions are adjustable,
6. The frequency of the movement sequences is adjustable.

A crank mechanism with adjustable amplitude and speed which is activated by an electric motor can be used to generate the back back-and-forth movement.

Another preferable design employs pneumatically and/or hydraulically activated pistons to produce the lateral movements of adjustable amplitude and frequency.

In order to prepare the patient for the exercises to be performed, heating elements can be fitted in the area of the backrest for the patient.

Figure 2:
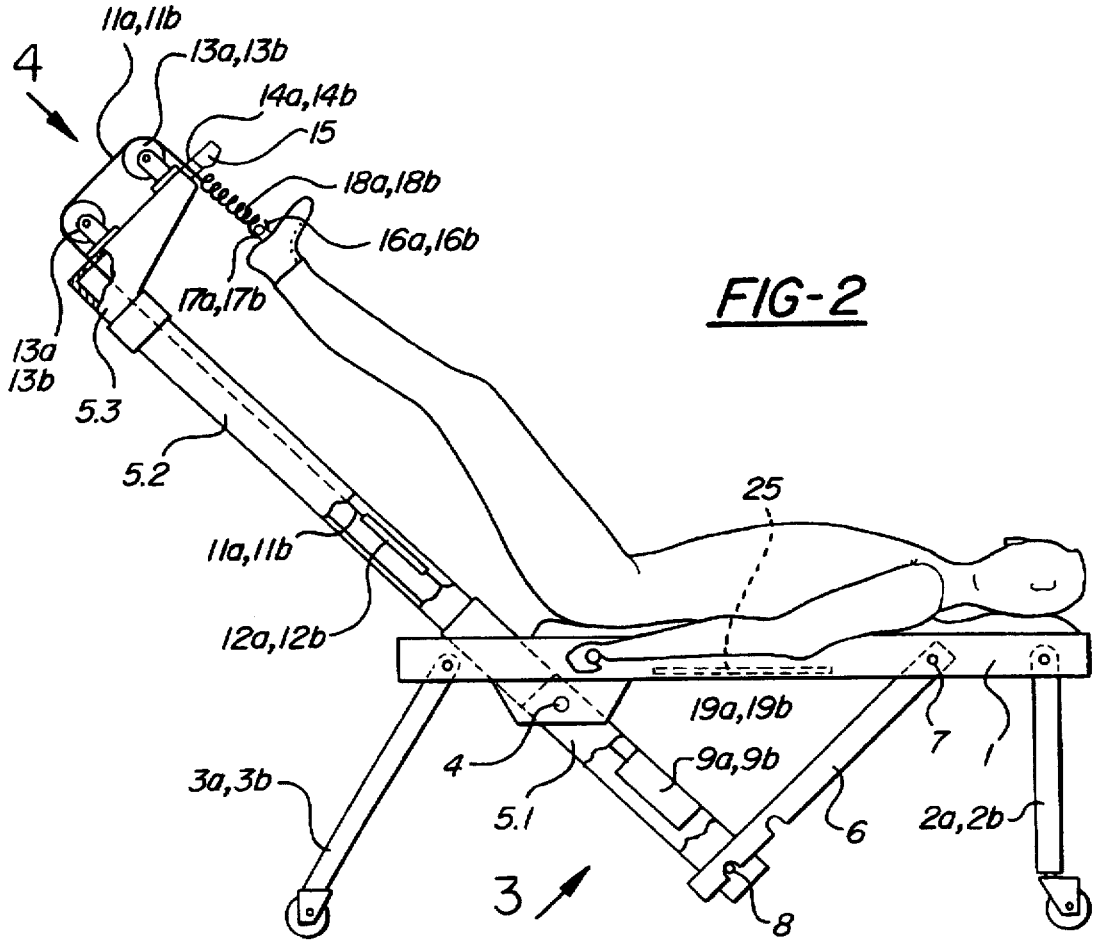
Figure 3:
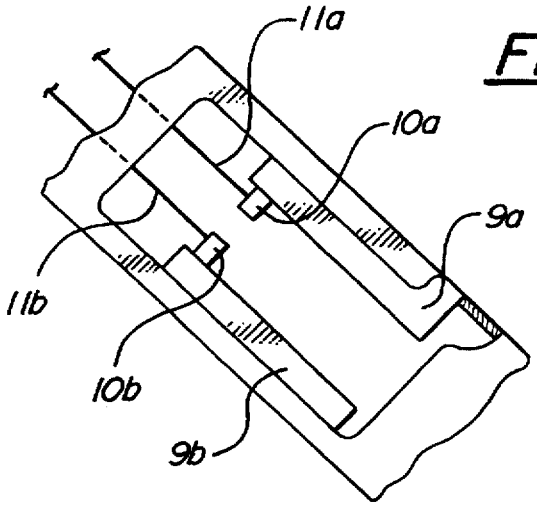
Figure 4:
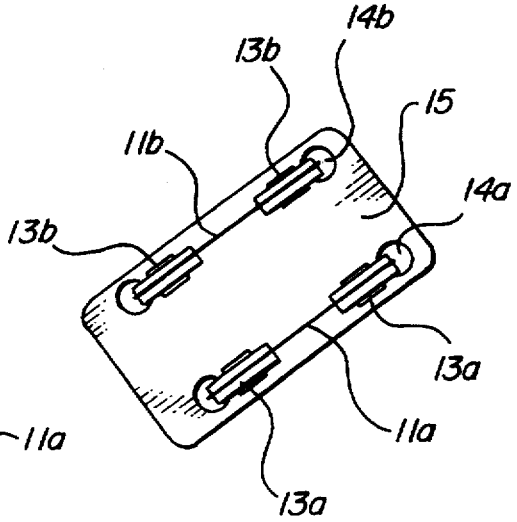
Figure 5:
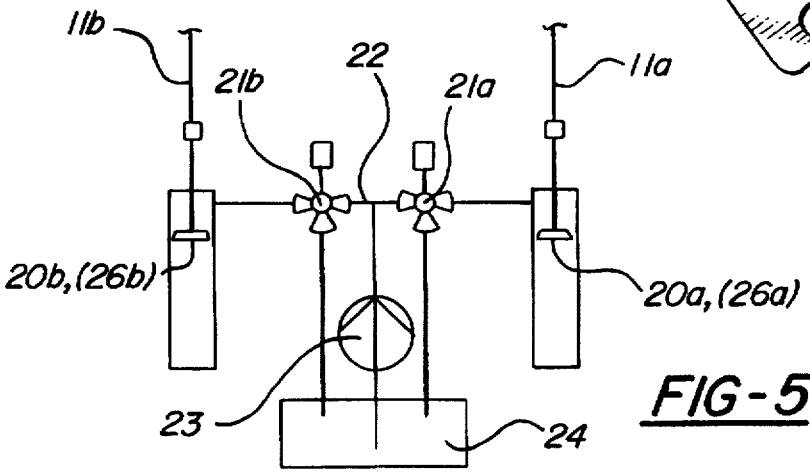
Figure 6:
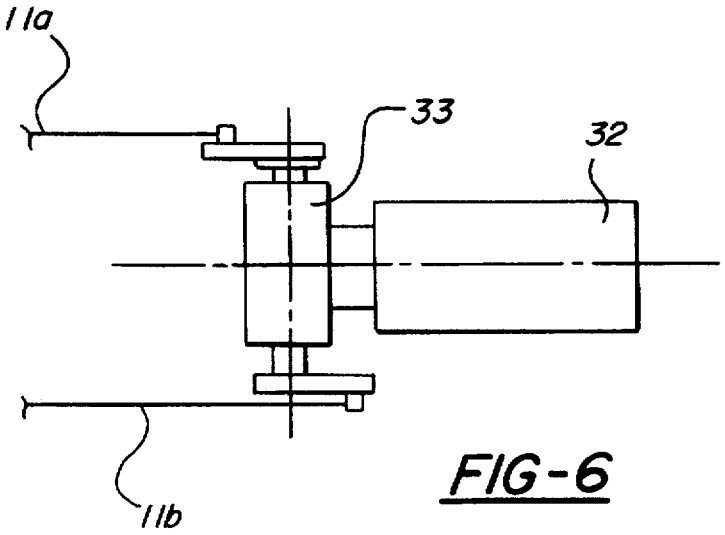

Practical examples of the invention are described below in more detail based on the drawings. The drawings show the following:

FIG. 1 Force-time diagrams for various force profiles,

FIG. 2 A view of the complete therapeutic device,

FIG. 3 A view of the linear movement elements in the direction of arrow X in FIG. 2, FIG. 4 A view of the tension cable routing in the direction of arrow Y in FIG. 2, FIG. 5 A schematic view of a hydraulic drive, and FIG. 6 A crank mechanism for generating increasing and decreasing forces in the cables.

FIG. 1 illustrates typical force curves in force-time diagrams and shows:

Curve a: Force-time profile with an identical force increase and decrease for both legs, where the forces act simultaneously, Curve b: Force profile as in Curve a for one leg, and the same with a phase shift of $\pi$ for the other leg, Curve c: Force-time profile with different force increase and decrease and a holding time at maximum force.

Known measures can be employed to achieve the technical execution of the invention concept, such as the classical crank mechanism which provides a sinusoid as the displacement curve, hydraulic or pneumatic pistons as drives to generate a back-and-forth movement, or also the electromechanical linear movement elements, with which the curves shown in FIG. 1 can be realised. The drives are switched by known electronic control units with clock generator, not to be described in more detail here, and can be influenced during the exercises.

The spinal therapeutic device is so simply designed as regards operation that its use can be compared to that of known home exercise machines. Although a therapist must provide an introduction and instruction, it should not be absolutely necessary for him to be present when performing the physical therapy exercises.

FIG. 2 shows the fundamental structure of the ready-to-use therapeutic device.

It consists of a hard-padded bench 1 which stands on four legs 2*a*, 2*b* and 3*a*, 3*b* equipped with lockable castors, where the legs can be folded up against the bench 1 in order to fold up the device.

The designations used for the structural components are supplemented in the case of symmetrical parts by the designation "a", for parts to the left, and "b" for parts to the right of the patient; accordingly, the left leg is (a) and the right leg (b).

The pivot joint 4 connects an extension consisting of three assemblies to the bench 1:

5.1 Extension section with drive units

5.2 Spar

5.3 Head of the extension with cable guides

Assemblies 5.1, 5.2 and 5.3 are joined by simple, known pin connections which are not described in further detail.

The strut 6 is used to retain the extension at specific angles, where 45° and 30° are preferred in this context. For this purpose, the strut 6, which pivots around pivot point 7, is equipped with two notches for the locking bolt 8.

The extension is preferably designed as a box girder with slits on the underside for mounting purposes. In order to fold up the device, the spar 5.2 with the extension head 5.3 is separated from the assembly 5.1 and the latter is folded up against the bench 1, similar to the legs.

Two conventional linear movement elements 9a and 9b are mounted in the bottom part 5.1 of the extension, which is connected to the bench 1 via pivot joint 4. The movement elements, which are shown more clearly in FIG. 3 as a view in the X direction, are equipped with controllable and adjustable electric motors which drive a chain or a spindle by way of a gearbox. One pin 10a and 10b which moves back-and-forth is connected to this chain or spindle. The stroke and speed can be changed using a control unit not described in further detail here.

Cables 11a and 11b are fixed to pins 10a and 10b. Spring elements 12a and 12b, which are tensioned by the pin travel, are incorporated in these cables and the resulting spring forces are transmitted via the cables to the feet of the patient as tensile forces. These springs can be helical springs, or also rubber bands comparable to expanders, the springs being exchangeable so that the tensile force can be adapted to the exercises to be performed by the patient via different spring stillnesses and/or paths of the movement elements.

The head of the extension is formed by the assembly 5.3, with the cable guides and return pulleys located at the patient's feet. FIG. 4 shows a practical example of this as a view in the Y direction.

The cables 11a and 11b are fed over two cable pulley pairs 13a and 13b through the sockets 14a and 14b to the feet of the patient. The pulleys and sockets are mounted on a cantilever plate 15 which projects far enough from the spar 5.2 that the patient can swing his legs. By selecting a longer spar and thus also longer cables, the distance from the sockets to the feet can be increased in order to give the legs more room for swinging and also spreading movements. The spar 5.2 can also be of telescopic design for this purpose, thus making it possible to easily adapt it to the length of the patient's legs.

The feet of the patient are held by sandal-like braces, the soles of which have eyes 16a and 16b which are suspended on hooks 17a and 17b of the cables. In order to be able to make this connection easily without help, helical springs 18a and 18b are provided which hold the cable ends in a favourable position for connection to the feet.

Grips 19a and 19b for each hand are attached to the bench 1 and used by the patient to support himself. Switching components (not shown) for controlling the linear movement elements, stroke and frequency are mounted on, or in the direct vicinity of, each grip, so that the patient can influence the magnitude of the forces and speeds during exercise.

The invention concept can also be realised by using hydraulic or pneumatic means. FIG. 5 shows an exemplary hydraulic solution in which two hydraulically or pneumatically activated pistons 20a, 26a and 20b, 26b are used, instead of the linear movement elements 9a and 9b.

The two cables 11a and 11b are driven by the single-acting cylinders. One multiway solenoid valve 21a and 21b per cylinder opens according to the program and releases the pressure line 22 to the cylinder. The oil pump 23 feeds the hydraulic oil from the tank 24 and generates pressure. After the valves are closed, the flow of pressurised oil is blocked and the oil flows via the second valve path out of the cylinder and back to the tank as a result of the piston movements caused by the relaxation of the springs. Displacement transducers and/or limit switches (not shown) inform the controller of the position of the pistons.

The program is designed so that an electronic clock generator with adjustable cycle time triggers the program steps and switches the solenoid valves in such a way that the pistons act simultaneously and in the same direction, or so that phase shifts can also be set between the two movements.

The application program can be supplemented in order to set the piston stroke, and thus the amplitude of the tensile force on the legs of the patient.

This form of solution of the invention concept again allows the patient to influence the exercises by operating the switching components on the hand grips 19a and 19b.

In order to prepare the patient for performing the exercises, it is often necessary to counteract tension in the muscles surrounding the spine via heat treatment. For this purpose, the invention provides for heating elements 25 in the padding of the bench 1 which warm the patient's back in the initial rest position. These heating elements—shown in FIG. 1—can be operated by the patient and are equipped with a temperature control.

Instead of the horizontal bench with backrest for the patient shown in FIG. 2, another practical example (not shown) can consist of a pivoting seat with a backrest and a legrest mounted on the top or side of a frame. The pivotal axis is preferably located at the end of the seat pointing towards the backrest. In order to prepare the patient for the exercises to be performed, the patient first sits down on the essentially upright seat. Heating elements included in the backrest or, if necessary, also in the seat, warm the patient's back in the initial sitting position and/or the subsequent sitting position. The patient is moved into an essentially horizontal supine position by pivoting the seat. After conclusion of the preparatory heat treatment, the seat, which pivots in relation to the backrest, and the leg rest, which pivots in relation to the seat, are moved into the most favourable position for the spinal therapy, so that the patient is approximately in the position shown in FIG. 2. In this case, the extension which guides the cables can consist of one or two spars attached to the side of the frame, on or between which the seat can be mounted in pivoting fashion. In FIG. 6 a conventional crank mechanism for generating increasing and decreasing forces in cables 11a and 11b is shown in a simplified manner.

I claim:

1. A spinal therapeutic device for generating tensile forces in the legs of a patient which stress the spine via the pelvis in order to treat spinal damage, the device comprising:

a bench means for supporting the body of the patient, a controllable drive means operatively connected to said bench means, a pair of spring elements connected to said drive means and including means for attaching to each foot of the patient respectively and a pair of cables connected to said drive means and spring elements, wherein said drive means produces back-and-forth longitudinal movement of each cable and spring element and includes means for shifting the phase between application of the movement to each cable and spring element thereby applying alternating traction to each foot of the patient.

2. Spinal therapeutic device as in claim 1, wherein the bench means in the area supporting the back of the patient is provided with electrical heating elements.

3. Spinal therapeutic device as in claim 1, wherein means are provided for changing the amplitude and frequency of the traction forces generated by the spring elements during the therapy program.

4. Spinal therapeutic device as in claim 3, wherein said drive means comprises an electric motor and a crank mechanism with adjustable amplitude and speed that is adapted to be activated by the electric motor and engages said spring means.

5. Spinal therapeutic device as in claim 4, wherein said bench means in the area supporting the back of the patient is provided with electrical heating elements.

6. Spinal therapeutic device as in claim 3, wherein said bench means in the area supporting the back of the patient is provided with electrical heating elements.

7. Spinal therapeutic device as in claim 3, wherein said drive means comprises pneumatically activated pistons.

8. Spinal therapeutic device as in claim 7, wherein said pneumatically activated pistons operate with adjustable amplitude and frequency.

9. Spinal therapeutic device as in claim 7, wherein said bench means in the area supporting the back of the patient is provided with electrical heating elements.

10. Spinal therapeutic device as in claim 3, wherein said drive means comprise hydraulically activated pistons.

11. Spinal therapeutic device as in claim 10, wherein said hydraulically activated pistons operate with adjustable amplitude and frequency.

12. Spinal therapeutic device as in claim 10, wherein said bench means in the area supporting the back of the patient is provided with electrical heating elements.

* * * * *